US006318305B1

(12) United States Patent
Takubo et al.

(10) Patent No.: US 6,318,305 B1
(45) **Date of Patent: *Nov. 20, 2001**

(54) WATER-TUBE BOILER

(75) Inventors: Noboru Takubo; Takanori Tanaka, both of Matsuyama (JP)

(73) Assignees: Miura Co., Ltd.; Miura Institute of Research & Development Co., Ltd., both of Ehime-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/560,871

(22) Filed: Apr. 28, 2000

(30) Foreign Application Priority Data

Apr. 30, 1999 (JP) ..... 11-123576

(51) Int. Cl.[7] ..... F22B 15/00

(52) U.S. Cl. ..... 122/235.11; 122/235.23; 122/367.1; 122/6 A

(58) Field of Search ..... 122/235.11, 235.23, 122/367.1, 367.2, 367.3, 7 R, 6 A, 18.4

(56) References Cited

U.S. PATENT DOCUMENTS

| | | | |
|---|---|---|---|
| 3,633,550 | 1/1972 | Kraus . | |
| 4,257,358 | 3/1981 | Watanabe . | |
| 4,453,496 | 6/1984 | Yoshinari . | |
| 4,825,813 | 5/1989 | Yoshinari et al. . | |
| 5,020,479 | 6/1991 | Suesada et al. . | |
| 5,199,384 | 4/1993 | Kayahara et al. . | |
| 5,273,001 | 12/1993 | Kayahara et al. . | |
| 5,353,748 | 10/1994 | Kayahara et al. . | |
| 6,116,196 * | 9/2000 | Watanabe et al. | 122/235.11 |

FOREIGN PATENT DOCUMENTS

A6078247 5/1985 (JP) .

* cited by examiner

*Primary Examiner*—Jiping Lu

(57) ABSTRACT

The invention provides a water-tube boiler which allows further NOx reduction and CO reduction with a simple construction of the boiler body and the burner itself. The water-tube boiler includes a first water tube array made up of a plurality of first water tubes arranged into an annular shape, a combustion chamber defined inside the first water tube array, a first opening defined at part of the first water tube array, a cooling water tube array made up of a plurality of cooling water tubes arranged into an annular shape in a zone within the combustion chamber where burning-reaction ongoing gas is present, gaps provided between adjacent cooling water tubes so as to permit the burning-reaction ongoing gas to flow through, and a burning-reaction continuing zone, where burning reaction is continuously effected, provided between the cooling water tube array and the first water tube array, whereby the burning-reaction ongoing gas generally uniformly contacts the individual cooling water tubes.

8 Claims, 8 Drawing Sheets

WATER-TUBE BOILER

BACKGROUND OF THE INVENTION

The present invention relates to water-tube boilers such as once-through boilers, natural circulation water-tube boilers and forced circulation water-tube boilers.

The water-tube boiler includes body of which is made up by water tubes. The body arrangement of such a water-tube boiler is, for example, that a plurality of water tubes are arranged into an annular shape. In the water-tube boiler of this form, a cylindrical space surrounded by the annular water tube array is used as a combustion chamber. In such a water-tube boiler, heat transfer primarily by radiation is performed within the combustion chamber, and then heat transfer primarily by convection is done in the downstream of the combustion chamber.

In recent years, such water-tube boilers are also desired to be further reduced in NOx and CO. The reduction in NOx, as it stands now, is implemented by fitting low-NOx burners or exhaust-gas re-circulation equipment to the existing boiler bodies. The reduction in CO is implemented by adjusting the state of combustion of the combustion equipment. However, further reduction in NOx and reduction in CO are demanded in keeping up with growing recognitions of environmental issues.

An object of the invention is to achieve further reduction in NOx and reduction in CO with simple structures of the boiler body and the burner.

In order to achieve the above object, the present invention provides a water-tube boiler comprising: a first water tube array made up of a plurality of first water tubes arranged into an annular shape; a combustion chamber defined inside the first water tube array; a first opening defined at part of the first water tube array; a cooling water tube array made up of a plurality of cooling water tubes arranged into an annular shape in a zone within the combustion chamber where burning-reaction ongoing gas is present; gaps provided between adjacent cooling water tubes so as to permit the burning-reaction ongoing gas to flow through; and a burning-reaction continuing zone, where burning reaction is continuously effected, provided between the cooling water tube array and the first water tube array, whereby the burning-reaction ongoing gas generally uniformly contacts the individual cooling water tubes.

In an embodiment of the invention, the water-tube boiler is characterized in that among the gaps, a specified number of gaps confronting the first opening are closed.

In an embodiment of the invention, the water-tube boiler is characterized in that among the gaps, width of gaps closer to the first opening is smaller than width of gaps farther from the first opening.

In an embodiment of the invention, the water-tube boiler is characterized in that a burner directed toward the combustion chamber is decentered from the center of the cooling water tube array so as to be away from the first opening.

In an embodiment of the invention, the water-tube boiler is characterized in that axis line of a burner directed toward the combustion chamber is tilted so as to be away from the first opening.

In an embodiment of the invention, the water-tube boiler is characterized in that the cooling water tube array is made up of a plurality of water tube arrays.

Further, in an embodiment of the invention, the water-tube boiler further comprises: a second water tube array made up of a plurality of second water tubes arranged into an annular shape outside the first water tube array; a second opening defined at part of the second water tube array; and a gas flow passage provided between the first water tube array and the second water tube array.

The present invention is embodied as a water-tube boiler of the multiple-tube type. Further, the water-tube boiler of the present invention is applied not only as steam boilers or hot water boilers, but also as heat medium boilers in which a heat medium is heated.

A first water tube array is made up by arranging the plurality of first water tubes into an annular shape, and a combustion chamber is defined inside this first water tube array. A first opening is provided at part of the first water tube array. This first opening may be provided as a single opening having an appropriate width in the circumferential direction, or as a plurality of openings divisionally by interveniently providing one or two first water tubes. A cooling water tube array is made up of a plurality of cooling water tubes arranged into an annular shape, in a zone within the combustion chamber where burning-reaction ongoing gas is present. Gaps are provided between adjacent cooling water tubes so as to permit the burning-reaction ongoing gas to flow through. The burning-reaction ongoing gas includes a flame, being a high-temperature gas under progress of burning reaction. That is, the cooling water tubes are placed within the flame, thus being in contact with the flame. Between the cooling water tube array and the first water tube array, a zone where burning reaction is continuously effected is provided.

In the combustion chamber, the burning-reaction ongoing gas tends to flow toward the first opening, causing a tendency that a larger amount of burning-reaction ongoing gas that contacts cooling water tubes located closer to the first opening while a smaller amount of burning-reaction ongoing gas that contacts cooling water tubes located farther from the first opening. However, the water-tube boiler of this invention is so constituted that the burning-reaction ongoing gas generally uniformly contacts the cooling water tubes in the following manner.

First, contrivance for the arrangement of the cooling water tubes is explained. Out of the gaps between the cooling water tubes, a specified number of gaps confronting the first opening are closed. Also among the gaps between the cooling water tubes, width of gaps closer to the first opening is smaller than width of gaps farther from the first opening. By these arrangements, the burning-reaction ongoing gas is inhibited from flowing short toward the first opening, so that the burning-reaction ongoing gas generally uniformly contacts the individual cooling water tubes.

Next, contrivance for the arrangement of the burner provided so as to be directed toward the combustion chamber is explained. The burner is decentered from the center of the cooling water tube array so as to be away from the first opening. Also, the axis line of the burner is tilted so as to be away from the first opening. By these arrangements, the burning-reaction ongoing gas is inhibited from expanding unevenly due to the arrangement of the cooling water tubes, so that the burning-reaction ongoing gas generally uniformly contacts the individual cooling water tubes.

Flow and reaction of the burning-reaction ongoing gas within the combustion chamber are explained in detail. Burning-reaction ongoing gas that has been generated by the fuel burning in the combustion chamber is cooled by the cooling water tubes, with the temperature lowered, by which the generation of thermal NOx is suppressed. The burning-reaction ongoing gas, which flows through the gaps between the cooling water tubes, contacts the overall surfaces of the cooling water tubes, thus being cooled. As can be explained for Zeldovich mechanism, the higher the temperature of burning reaction, the higher the generation rate of thermal NOx increases considerably; the lower the temperature of burning reaction, the lower the generation rate of thermal NOx, where the generation rate of thermal NOx is considerably lower when the temperature of burning reaction is 1400° C. or lower. Therefore, number and heat transfer area of the cooling water tubes are set in order that the temperature of burning reaction becomes 1400° C. or lower. When the cooling water tube array is made up of a plurality of water tube arrays, the heat transfer area per unit space is increased so that NOx reduction effect by cooling is improved.

The burning-reaction ongoing gas that has passed through the gaps between the cooling water tubes continues burning reaction in a zone between the cooling water tube arrays and the first water tube array, where burning reactions of intermediate products of burning reactions such as CO and HC and unburnt components of the fuel are continuously effected. Since CO remaining in the burning-reaction ongoing gas is oxidized into $CO_2$, the amount of CO emission from the boiler is reduced.

As described above, by the arrangement that the burning-reaction ongoing gas generally uniformly contacts the individual cooling water tubes, the NOx reduction effect by cooling can be obtained generally uniformly at the individual cooling water tubes. Therefore, increases in NOx due to insufficient cooling and increases in CO due to excessive cooling, which would occur upon the occurrence of variations in cooling, can be prevented.

It is preferable, depending on the circumstances of embodiment, that a second water tube array is provided by arranging a plurality of second water tubes. A gas flow passage is defined between the first water tube array and the second water tube array, and a second opening is provided at part of the second water tube array. This second opening may be provided as a single opening or a plurality of openings, like the first opening. Within the combustion chamber, radiant heat transfer and convective heat transfer are effected. The gas that has nearly completed the burning reaction flows into the gas flow passage through the first opening, where convective heat transfer is primarily effected in the gas flow passage. By providing the second water tube array, the amount of heat transfer can be increased. The burning-reaction completed gas is exhausted outside through the second opening.

DETAILED DESCRIPTION OF THE PREFERRED EMBODIMENTS

Figure 1:
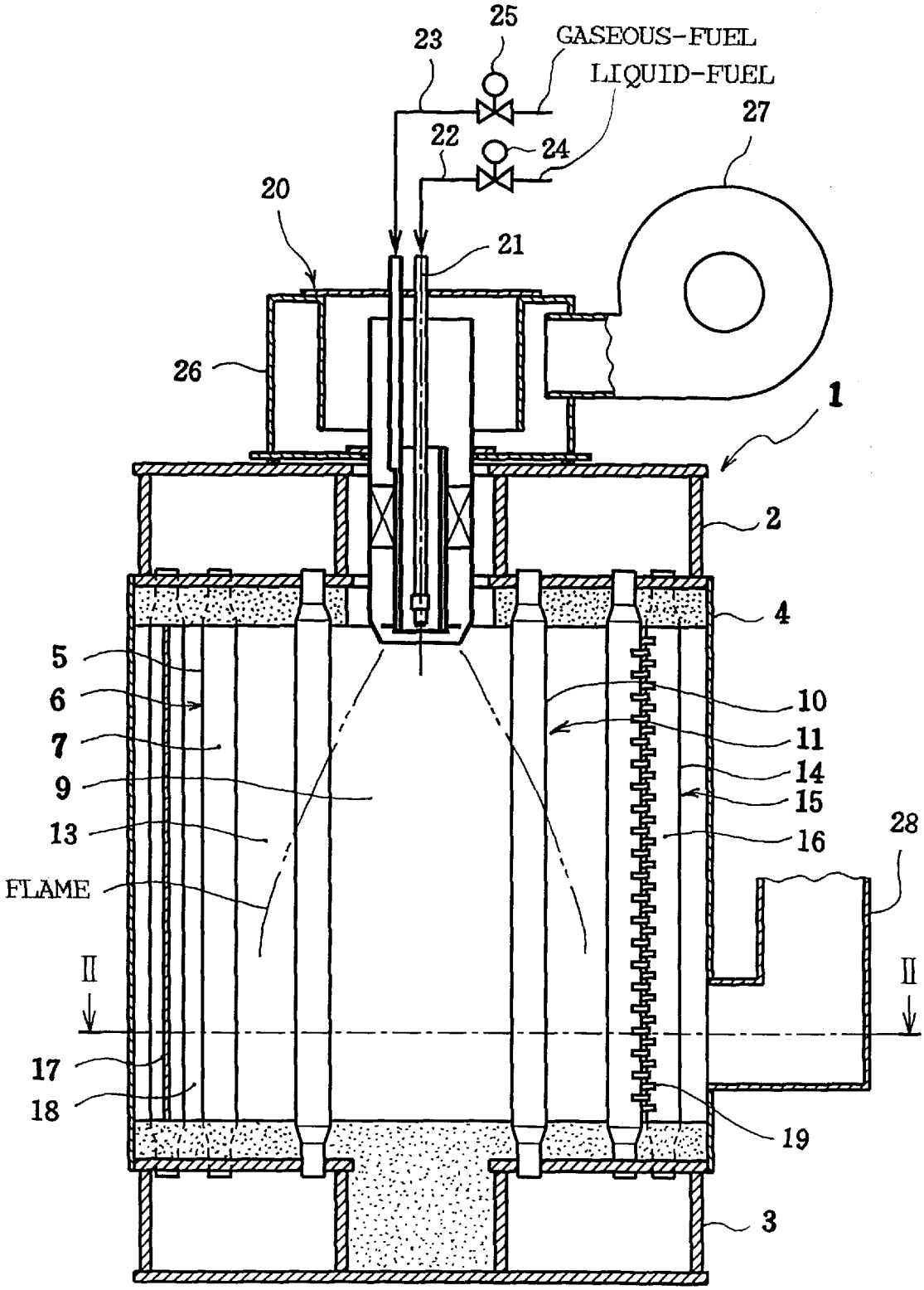
FIG. 1 is an explanatory view of a longitudinal section in a first embodiment of the invention.
Figure 2:
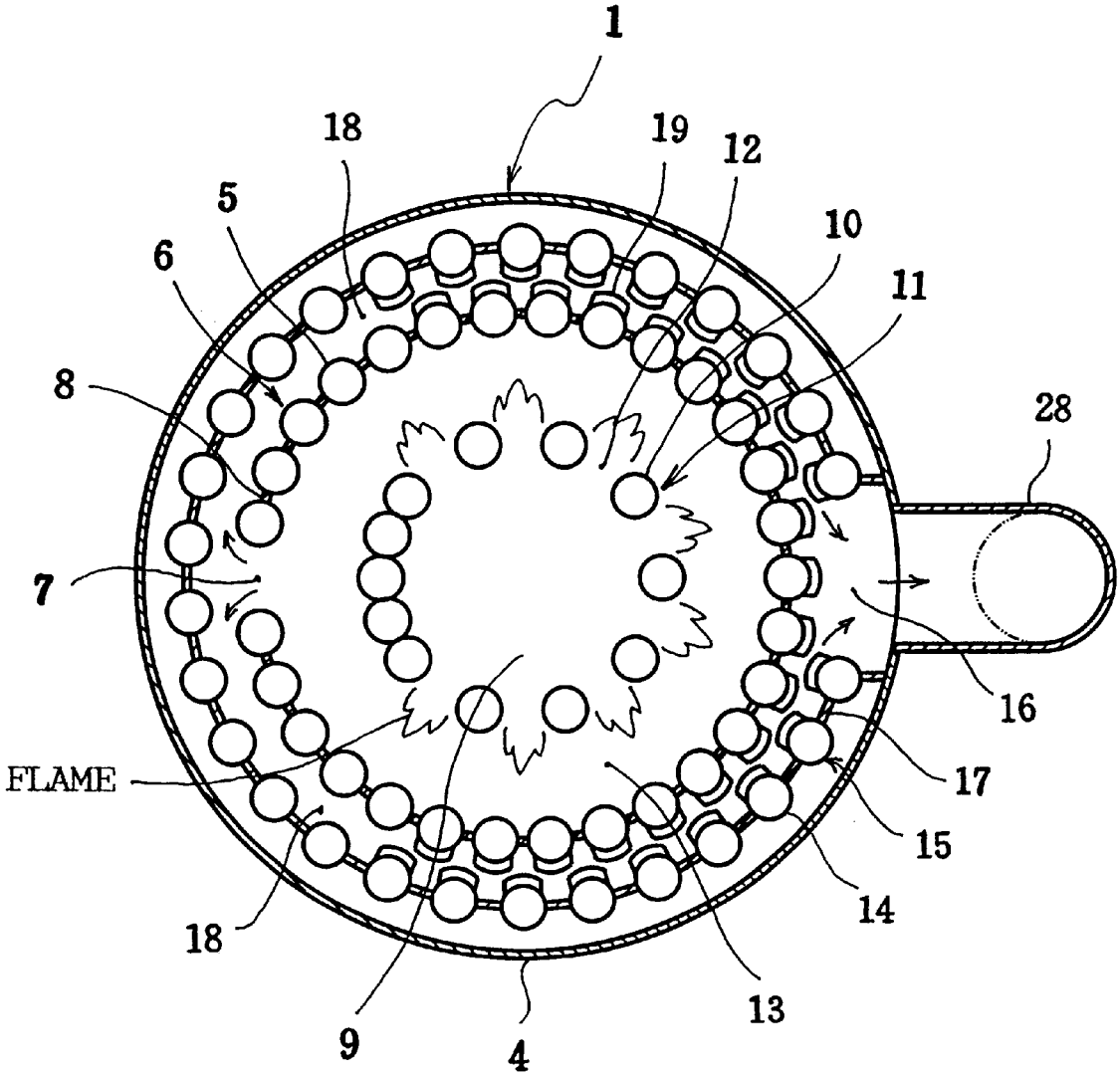
FIG. 2 is an explanatory view of a section taken along the line II—II of FIG. 1.

Hereinbelow, a first embodiment in which the present invention is applied to a multiple-tube type once-through boiler is described with reference to FIGS. 1 and 2. FIG. 1 is an explanatory view of a longitudinal section of the first embodiment of the invention, and FIG. 2 is an explanatory view of a cross section taken along the line II—II of FIG. 1.

A boiler body 1 has an upper header 2 and a lower header 3 arranged away from each other by a specified distance. An outer wall 4 is disposed between outer circumferences of these upper header 2 and lower header 3.

Between the upper header 2 and the lower header 3, a plurality (twenty-nine in the first embodiment) of first water tubes 5 are arranged in an annular shape. These first water tubes 5 constitute an annular first water tube array 6, and upper and lower end portions of each first water tube 5 are connected to the upper header 2 and the lower header 3, respectively. This first water tube array 6 has a first opening 7 at one portion thereof. Between the first water tubes 5 except the first opening 7, first longitudinal fin members 8, 8, . . . are provided, so that the first water tubes 5 are connected to one another by the first longitudinal fin members 8.

A combustion chamber 9 is defined inside the first water tube array 6. In a zone where burning-reaction ongoing gas is present (hereinafter, referred to as "burning reaction zone"), a plurality (twelve in the first embodiment) of cooling water tubes 10 are arranged in an annular shape. These cooling water tubes 10 constitute an annular cooling water tube array 11, and upper and lower end portions of each cooling water tube 10 are connected to the upper header 2 and the lower header 3, respectively. The cooling water tube array 11 in this first embodiment comprises one annular water tube array, and a specified number (five in the first embodiment) of cooling water tubes 10 confronting the first opening 7 are placed in close contact with one another. Between adjacent cooling water tubes 10 except these cooling water tubes 10 in close-contact placement, are defined gaps 12 that permit the burning-reaction ongoing gas to flow.

A zone 13 where burning reactions of intermediate products of burning reactions such as CO and HC and unburnt components of the fuel are continuously effected (hereinafter, referred to as "burning-reaction continuing zone") is provided between the first water tube array 6 and the cooling water tube array 11. Within this burning-reaction continuing zone 13, no heat-absorbing members such as the water tubes 5 are present.

Outside the first water tube array 6, a plurality (twenty-eight in the first embodiment) of second water tubes 14 are arranged in an annular shape. These second water tubes 14 constitute an annular second water tube array 15, and upper and lower end portions of each second water tube 14 are connected to the upper header 2 and the lower header 3, respectively. This second water tube array 15 has a second opening 16 at one portion thereof. This second opening 16 is provided about 180 degree opposite to the first opening 7 of the first water tube array 6. Between the second water tubes 14 except the second opening 16, second longitudinal fin members 17, 17, . . . are provided, so that the second water tubes 14 are connected to one another by the second longitudinal fin members 17. Between the first water tube array 6 and the second water tube array 15, is defined a gas flow passage 18 through which gas that has completed burning reaction flows. This gas flow passage 18 communicates with the combustion chamber 9 via the first opening 7.

A plurality of transverse fin members 19 are provided in a multiple-stage form on the gas flow passage 18 side heat-transfer surfaces of the first water tubes 5 and the second water tubes 14. These transverse fin members 19 are intended to increase the amount of heat transfer in the gas flow passage 18. On the downstream side of the gas flow passage 18, gas temperature would lower so that gas volume would decrease, causing the gas flow rate to lower, resulting in a lowered amount of heat transfer as compared with the upstream side. However, by the provision of the transverse fin members 19, the amount of heat transfer on the downstream side can be increased. Also, in the gas flow passage 18, gas temperature is the higher increasingly on the upstream side, and heat transfer load in the first water tubes 5 and the second water tubes 14 is also the higher increasingly on the upstream side. Therefore, the transverse fin members 19 are not provided at a specified number of first water tubes 5 and second water tubes 14, as counted from the first opening 7, so that the heat transfer load on the upstream side is prevented from increasing too high.

Above the combustion chamber 9, a burner 20 is mounted. This burner 20 is inserted at an inward center of the upper header 2 toward the combustion chamber 9. The axis line 21 of the burner 20 and the first water tubes 5 are generally parallel to each other. The burner 20 is a burner which is used selectively switchably between liquid fuel and gas fuel. A liquid fuel supply line 22 and a gas fuel supply line 23 are connected to the burner 20. As fuel switching means, a liquid fuel valve 24 is provided on the liquid fuel supply line 22, and a gas fuel valve 25 is provided on the gas fuel supply line 23. Also, the burner 20 is equipped with a wind box 26 and a blower 27.

Whereas the burning-reaction zone is defined by the burner 20 within the combustion chamber 9, the cooling water tubes 10 are placed in a zone where the flame is present (hereinafter, referred to as "flame present zone") out of the burning-reaction zone. Also, with regard to the cooling water tubes 10, their number of tubes, heat transfer area and the like are set so that the temperature of the burning-reaction ongoing gas after contact will be not more than 1400° C.

On the outer wall 4, a chimney 28 is provided. This chimney 28 communicates with the gas flow passage 18 via the second opening 16.

In the once-through boiler of the above constitution, when the burner 20 is activated, there arises burning-reaction ongoing gas within the combustion chamber 9. In the initial stage of the burning reaction of this burning-reaction ongoing gas, fuel decomposition is performed and then the decomposed fuel reacts with oxygen vigorously. Then at the succeeding stage, such intermediate products as CO and HC that have been generated in the burning reaction above are put into further reaction, and thus burning-reaction completed gas, which has completed burning reaction, is exhausted outside as exhaust gas. In the region where the burning reaction is vigorously effected, there occurs a flame, normally.

The burning-reaction ongoing gas flows through central part of the cooling water tube array 11 nearly along its axis, as the gas expands toward the lower header 3, thus flowing into the burning-reaction continuing zone 13 through the gaps 12. Accordingly, as shown in FIG. 1, the flame is formed beyond the cooling water tube array 11 as the burning-reaction ongoing gas flows along. For this reason, the cooling water tubes 10 are located inside the flame-present zone within the burning reaction zone. Then, the burning-reaction ongoing gas that causes the flame, when passing through the gaps 12, exchanges heat with heated fluid in the cooling water tubes 10. The burning-reaction ongoing gas is rapidly cooled by this heat exchange, with the temperature lowered, by which the generation of thermal NOx is suppressed.

When the burning-reaction ongoing gas contacts the cooling water tubes 10, the burning-reaction ongoing gas is inhibited from flowing short toward the first opening 7 by virtue of the close-contact placement of the cooling water tubes 10. That is, it does not occur that a larger amount of burning-reaction ongoing gas that contacts cooling water tubes 10 located closer to the first opening 7 while a smaller amount of burning-reaction ongoing gas that contacts cooling water tubes 10 located farther from the first opening 7, but the burning-reaction ongoing gas contact the individual cooling water tubes 10 generally uniformly. Accordingly, cooling of the burning-reaction ongoing gas becomes uniform, so that increases in NOx due to generation of insufficient cooling portions are prevented, while increases in CO due to generation of excessively cooled portions are prevented.

The burning-reaction ongoing gas that has passed through the gaps 12 flows through within the burning-reaction continuing zone 13, where the burning-reaction ongoing gas makes almost no contact with any member that performs heat exchange such as the cooling water tubes 10 until reaching the first opening 7, so that the burning-reaction ongoing gas flows while holding a relatively high temperature. Therefore, the burning-reaction ongoing gas flows through the burning-reaction continuing zone 13 while continuing to make burning reaction, while an oxidation reaction from CO to $CO_2$ is accelerated. In this burning-reaction continuing zone 13, besides the aforementioned oxidation reaction, oxidation reactions of the intermediate products, unburnt components of the fuel and the like are also carried out.

In order to ensure the occurrence of oxidation reaction from CO to $CO_2$ while the burning-reaction ongoing gas flows through the burning-reaction continuing zone 13, the burning-reaction ongoing gas needs to be maintained above a specified temperature and besides a reaction time more than a specified time is necessary. According to the first embodiment, by the close-contact placement of the cooling water tubes 10 placed on one side where the cooling water tubes 10 confront the first opening 7, the burning-reaction ongoing gas is prevented from being flowing short toward the first opening 7, and the burning-reaction ongoing gas flows over a relatively long distance within the burning-reaction continuing zone 13. Therefore, sufficient reaction time can be obtained so that oxidation reaction from CO to $CO_2$ can be securely produced within the burning-reaction continuing zone 13.

Then, the burning-reaction ongoing gas becomes a high-temperature gas that has nearly completed the burning reaction, flowing into the gas flow passage 18 through the first opening 7. When flowing into the gas flow passage 18, the burning-reaction completed gas is diverted into two directions. During the passage of the burning-reaction completed gas through the gas flow passage 18, heat is transferred to heated fluid within the first water tubes 5 and the second water tubes 14. The burning-reaction completed gases that joined at the second opening 16 are exhausted outside as exhaust gas through the chimney 28.

The heated fluid in the cooling water tubes 10, the first water tubes 5 and the second water tubes 14 goes up while being heated, and then taken out as steam from the upper header 2.

The once-through boiler of the above first embodiment is explained further concretely. This first embodiment example is embodied as a once-through boiler having an evaporation amount of 3000 kg per hour. The outer diameter of the cooling water tubes 10, the first water tubes 5 and the second water tubes 14 is about 60 mm. The temperature of the flame produced from the burner 20 is about 1800° C., and the temperature of the flame is lowered to about 1100° C. by the cooling with the cooling water tubes 10. This temperature is lower than the temperature (about 1400° C.) at which the amount of thermal NOx generation is substantially lowered. As a result of this, the once-through boiler can be provided as one of less NOx emission. In addition, the NOx emission of the once-through boiler of the first embodiment is about 30 ppm equivalent to 0% $O_2$. Besides, the temperature is higher than the temperature (about 800° C.) at which the oxidation reaction from CO to $CO_2$ is carried out vigorously. Therefore, while the burning-reaction ongoing gas flows through within the burning-reaction continuing zone 13, the oxidation reaction from CO to $CO_2$ is carried out vigorously, thus allowing the once-through boiler to be a once-through boiler involving less CO emission. The CO emission amount of the once-through boiler of the above first embodiment is about 15 ppm.

As seen above, in the once-through boiler of the first embodiment, the temperature of burning-reaction ongoing gas that has flowed out from the gaps 12 of the cooling water tube array 11 is controlled to about 1100° C. However, it should be controlled to within a range of 800 to 1400° C. depending on the degree to which NOx reduction and CO reduction are required. In this connection, the temperature of burning-reaction ongoing gas that flows out from the gaps 12 is preferably as low as possible in terms of the NOx reduction, while it is preferably as high as possible in terms of the CO reduction. From this point of view, the temperature is more preferably set within a range of 900 to 1300° C.

The burner 20 is not limited to burner of any specific type, but may be burner of various types. For example, the burner 20 may be premixing type burner or diffuse-combustion type burner or other various types of burners such as vaporizing-combustion type burner.

Figure 3:
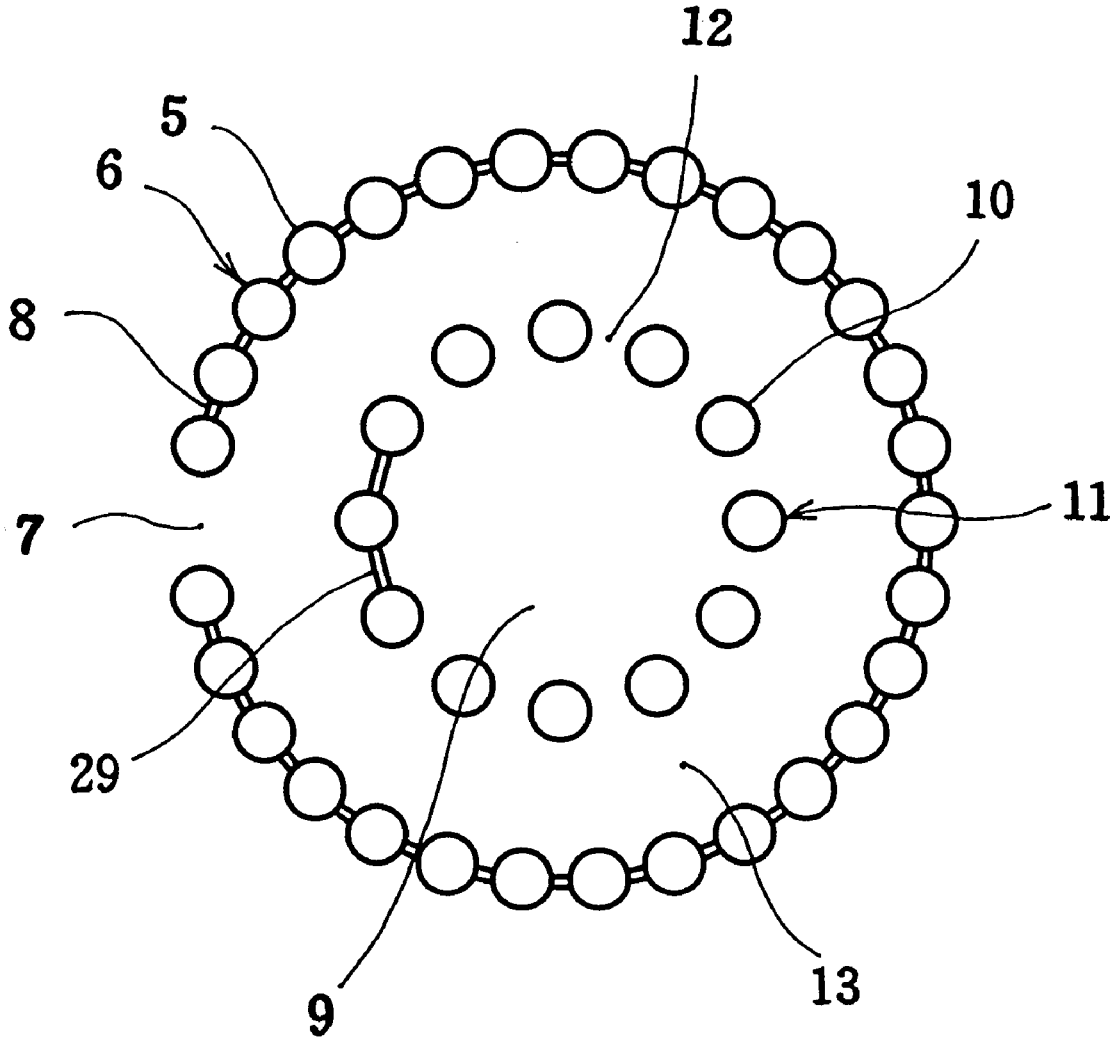
FIG. 3 is an explanatory view of a cross section schematically showing an arrangement example of the cooling water tubes in a second embodiment of the invention.
Figure 4:
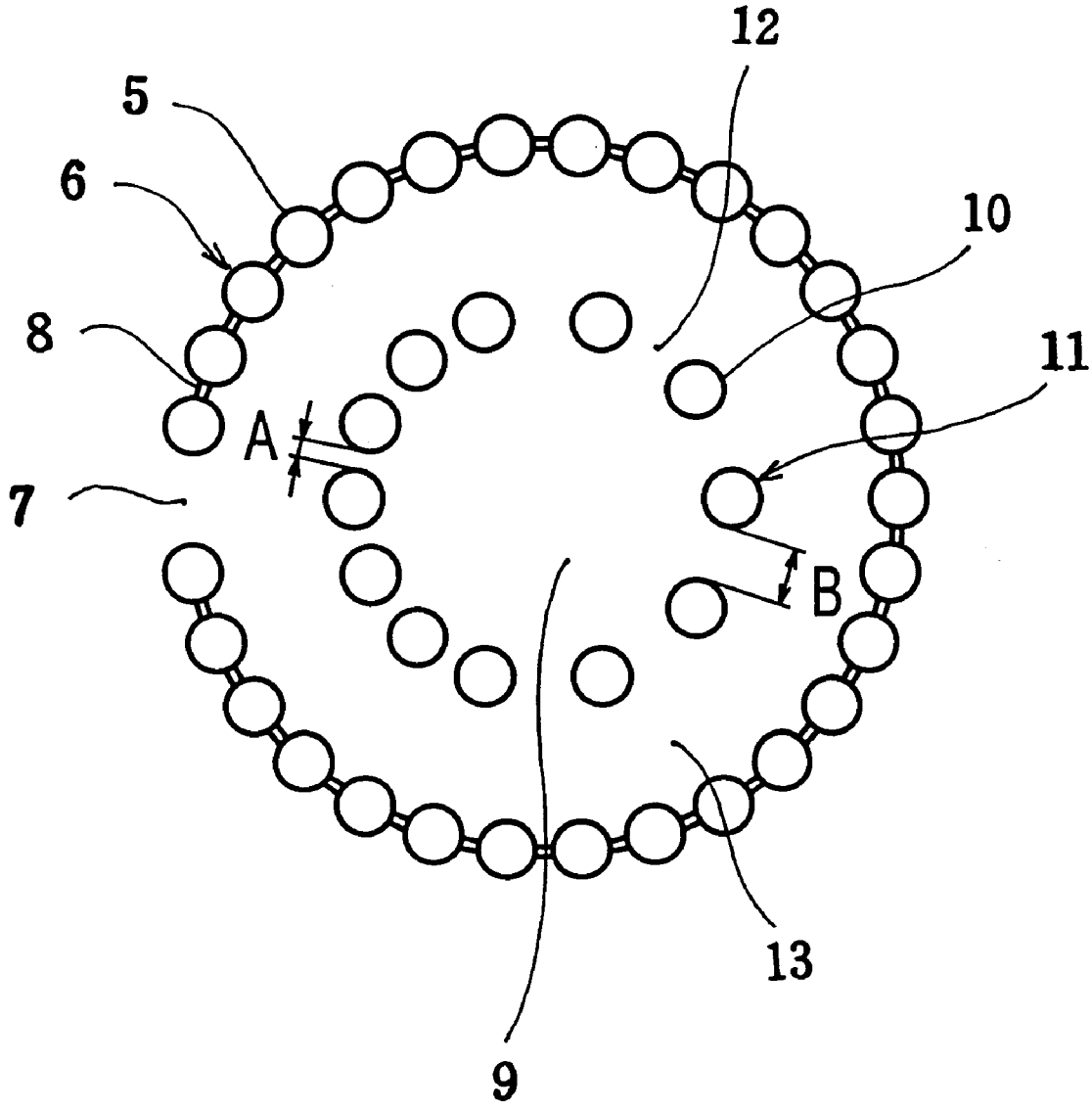
FIG. 4 is an explanatory view of a cross section schematically showing an arrangement example of the cooling water tubes in a third embodiment of the invention.
Figure 5:
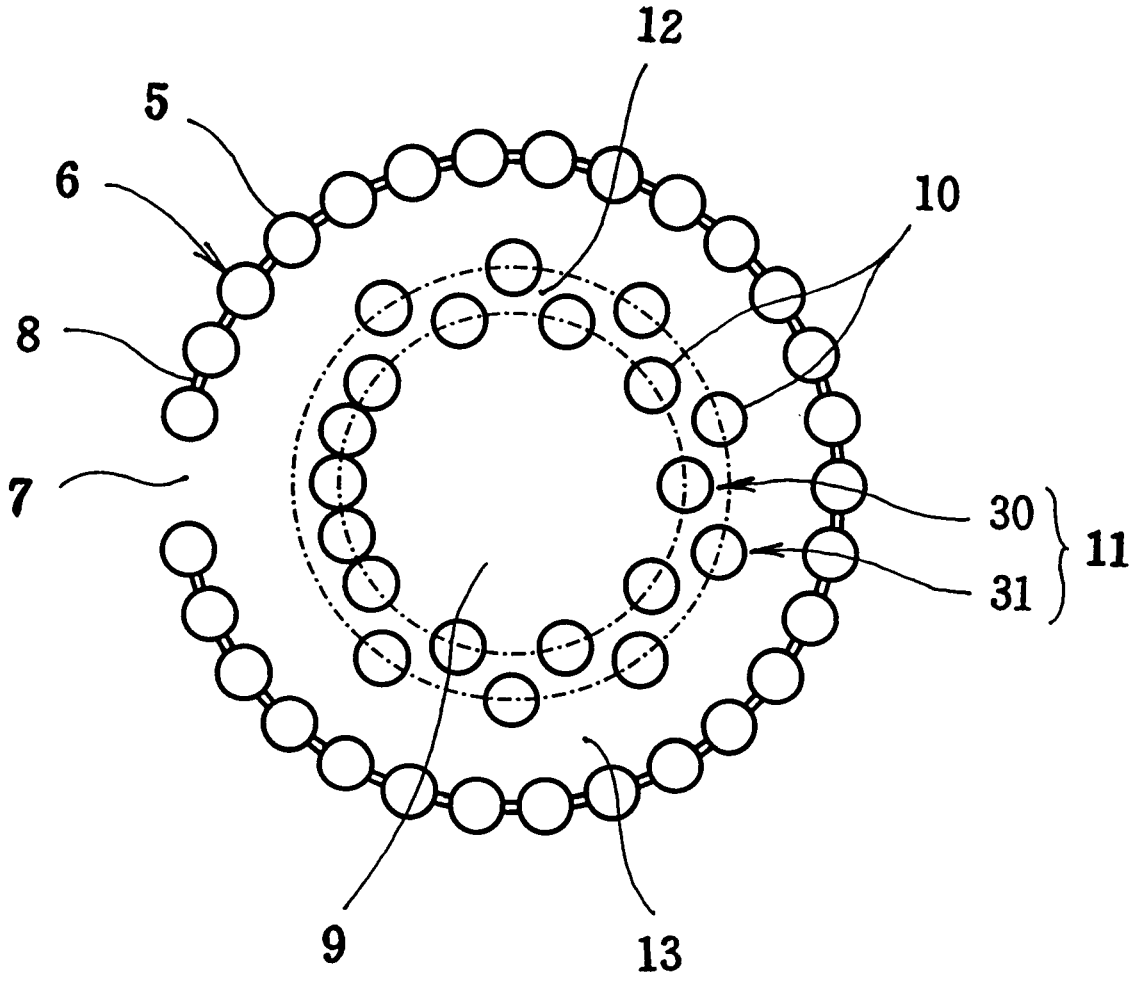
FIG. 5 is an explanatory view of a cross section schematically showing an arrangement example of the cooling water tubes in a fourth embodiment of the invention.

Next, other embodiments for the placement of the cooling water tubes 10 are described with reference to FIGS. 3 to 5. In FIGS. 3 to 5, the cooling water tube array 11 and the first water tube array 6 only are shown, and the rest of the constitution is omitted. Also, in the description of the following embodiments, the same constituent members as in the first embodiment are designated by like reference numerals and their detailed description is omitted.

In a second embodiment shown in FIG. 3, the cooling water tube array 11 is formed of one annular water tube array, and among the gaps 12 between the cooling water tubes 10, gaps 12 confronting the first opening 7 are closed by a specified number (two in the second embodiment) of closure members 29. More specifically, the cooling water tubes 10 are arranged generally circularly and generally equidistantly from one another, where among the gaps 12, gaps 12 closer to the first opening 7 are closed by the closure members 29. By providing these closure members 29, the burning-reaction ongoing gas is inhibited from flowing short toward the first opening 7, so that the burning-reaction ongoing gas generally uniformly contacts the individual cooling water tubes 10. As a result, the same effects of NOx reduction and CO reduction as in the first embodiment can be obtained.

In a third embodiment shown in FIG. 4, the cooling water tube array 11 is formed of one annular water tube array, and among the gaps 12 between the cooling water tubes 10, a width A of gaps 12 closer to the first opening 7 is smaller than a width B of gaps 12 farther from the first opening 7. More specifically, the width A of the gaps 12 closer to the first opening 7 is about ⅓ of the width B of the gaps 12 farther from first opening 7. By making the width A smaller than the width B, the amount of the burning-reaction ongoing gas that flows short toward the first opening 7 lessens, so that the burning-reaction ongoing gas generally uniformly contacts the individual cooling water tubes 10. As a result, the same effects of NOx reduction and CO reduction as in the first embodiment can be obtained. Whereas two kinds widths, width A and width B, are shown as the width of the gaps 12 in the embodiment shown, it is also possible to set three or more kinds of widths, or to set the widths of the gaps 12 in proportion to the distance from the first opening 7.

In a fourth embodiment shown in FIG. 5, the cooling water tube array 11 is formed of two annular water tube arrays, an inner cooling water tube array 30 and an outer cooling water tube array 31. The inner cooling water tube array 30 is arranged in such a way that a specified number of cooling water tubes 10 confronting the first opening 7 are placed in close contact with one another, as in the first embodiment. The cooling water tubes 10 of the outer cooling water tube array 31 are placed so as to confront the gaps 12 of the inner cooling water tube array 30, respectively, and gaps 12 that permit the flow of the burning-reaction ongoing gas are formed also between the cooling water tubes 10 of the inner cooling water tube array 30 and the cooling water tubes 10 of the outer cooling water tube array 31. By these arrangements, the burning-reaction ongoing gas is inhibited from flowing short toward the first opening 7, so that the burning-reaction ongoing gas generally uniformly contacts the individual cooling water tubes 10. As a result, the same effects of NOx reduction and CO reduction as in the first embodiment can be obtained. Further, heat transfer area per unit space of the cooling water tube array 11 is increased, so that the NOx reduction effect by cooling is improved. Depending on the circumstances of the embodiment, the constitution of the second embodiment or the third embodiment may also be applied as the inner cooling water tube array 30.

Figure 6:
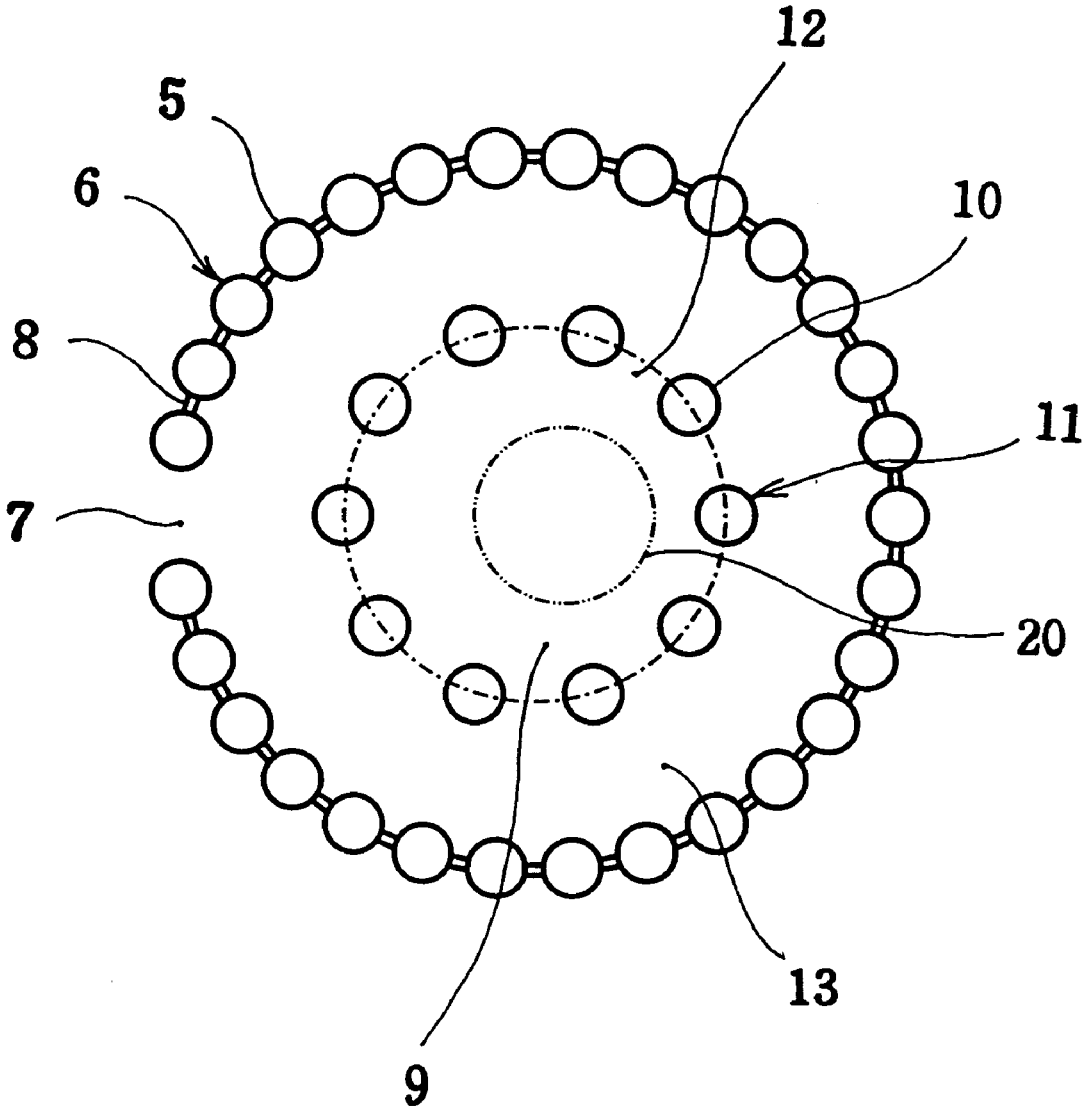
FIG. 6 is an explanatory view of a cross section schematically showing an arrangement example of the burner in a fifth embodiment of the invention.
Figure 7:
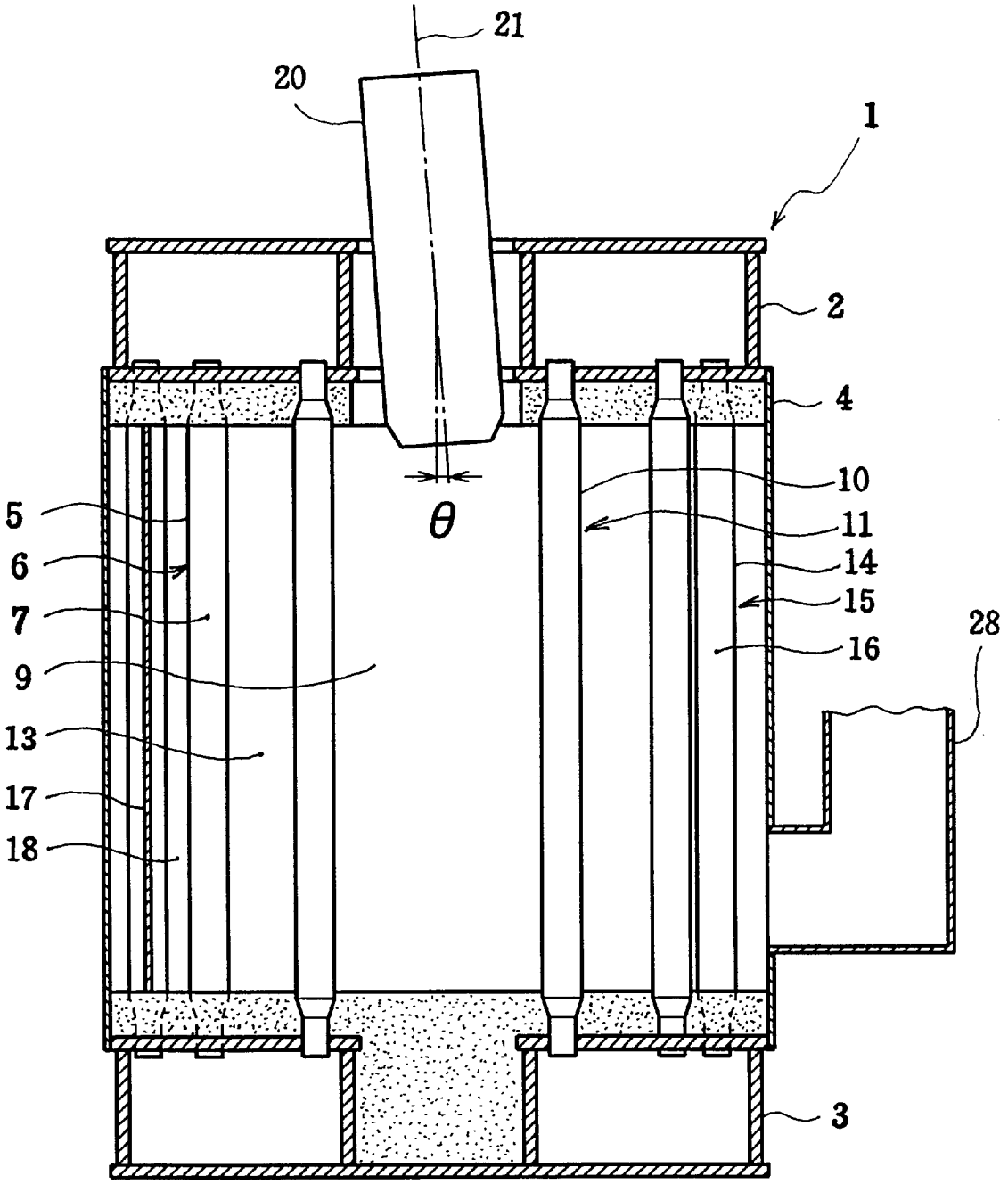
FIG. 7 is an explanatory view of a longitudinal section schematically showing an arrangement example of the burner in a sixth embodiment of the invention.

Further, other embodiments for the placement of the burner 20 are explained with reference to FIGS. 6 and 7. In FIG. 6, the cooling water tube array 11 and the first water tube array 6 only are shown, and the rest of the constitution is omitted. In FIG. 7, illustration of detailed arrangement of the burner 20 is omitted. Further, in the following description of the embodiments, the same constituent members as in the first embodiment are designated by like reference numerals and their detailed description is omitted.

In a fifth embodiment shown in FIG. 6, the burner 20 is placed so as to be decentered from the center of the cooling water tube array 11 so as to be away from the first opening 7. Whereas the burning-reaction ongoing gas tends to expand in such an unevenness as to be directed toward the first opening 7, the decentered placement of the burner 20 inhibits the burning-reaction ongoing gas from unevenly contacting the individual cooling water tubes 10, so that the burning-reaction ongoing gas generally uniformly contacts the individual cooling water tubes 10. As a result, the same effects of NOx reduction and CO reduction as in the first embodiment can be obtained. Whereas the cooling water tubes 10 are arranged generally circularly and generally equidistantly from one another, the arrangement of the cooling water tubes 10 shown in the first embodiment, the second embodiment, the third embodiment or the fourth embodiment is also applicable.

In a sixth embodiment shown in FIG. 7, the axis line 21 of the burner 20 is tilted so as to be away from the first opening 7. The tilt angle θ is set to about 5 degrees. Whereas the burning-reaction ongoing gas tends to expand in such an unevenness as to be directed toward the first opening 7, the tilted burner 20 inhibits the burning-reaction ongoing gas from unevenly contacting the individual cooling water tubes 10, so that the burning-reaction ongoing gas generally uniformly contacts the individual cooling water tubes 10. As a result, the same effects of NOx reduction and CO reduction as in the first embodiment can be obtained.

Figure 8:
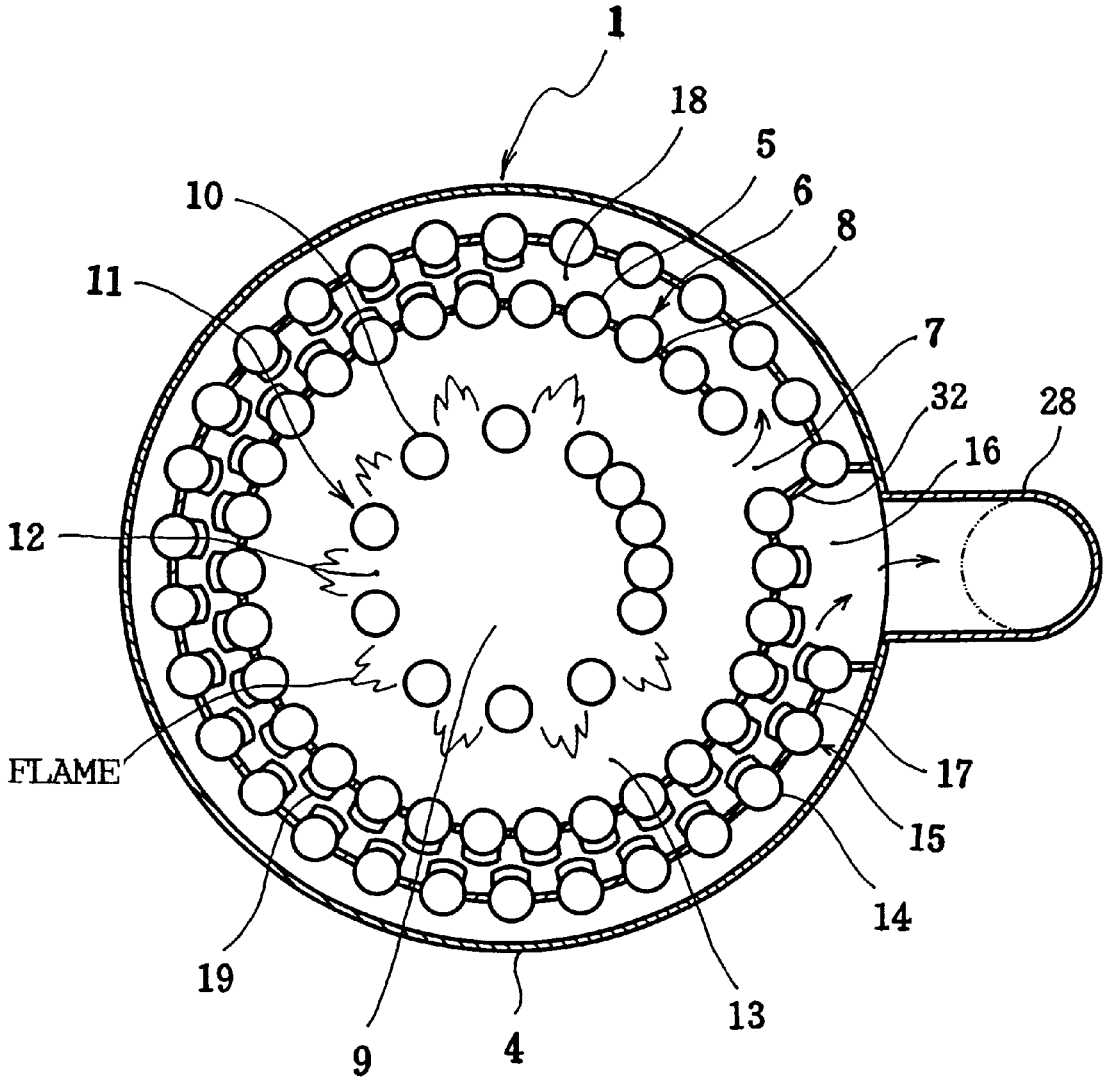
FIG. 8 is an explanatory view of a cross section schematically showing a constitutional example of the gas flow passage in a seventh embodiment of the invention.

Further, another embodiment for the gas flow passage 18 is described with reference to FIG. 8. The same constituent members as in the first embodiment are designated by like reference numerals and their detailed description is omitted. In a seventh embodiment shown in FIG. 8, the gas flow passage 18 is not diverted into two directions at the exit of the first opening 7, but flows only in one direction. The first water tube array 6 and the second water tube array 15 are joined together by a partitioning wall member 32 at near the first opening 7, so that the gas flow passage 18 starts at one side of the partitioning wall member 32 and ends at the other side, running around the outside of the first water tube array 6. The arrangement of the cooling water tube array 11 is similar to that of the first embodiment, and the effects of NOx reduction and CO reduction are also similar to those of the first embodiment.

As shown hereinabove, according to the present invention, further NOx reduction and CO reduction can be achieved with a simple constitution by virtue of contrivances for the arrangement of water tubes and the arrangement of the burner. Thus, a water-tube boiler of clean exhaust gas responding to environmental issues can be offered.

What is claimed is:

1. A water-tube boiler comprising:

a first water tube array made up of a plurality of first water tubes arranged into an annular shape;

a combustion chamber defined inside the first water tube array;

a first opening defined at part of the first water tube array;

a cooling water tube array made up of a plurality of cooling water tubes arranged into an annular shape in a zone within the combustion chamber where burning-reaction ongoing gas is present;

gaps provided between adjacent cooling water tubes so as to permit the burning-reaction ongoing gas to flow through; and a burning-reaction continuing zone, where burning reaction is continuously effected, provided in a space between the cooling water tube array and the first water tube array, whereby the burning-reaction ongoing gas generally uniformly contacts the individual cooling water tubes wherein said cooling water tubes, are constructed and arranged so that a temperature of the burning-reaction after contacting said cooling water tubes is lowered to 1400° C. or lower, whereby generation of NOx is reduced.

2. The water-tube boiler according to claim 1, wherein among the gaps, a specified number of gaps confronting the first opening are closed.

3. The water-tube boiler according to claim 1, wherein among the gaps, width of gaps closer to the first opening is smaller than width of gaps farther from the first opening.

4. The water-tube boiler according to claim 1, wherein a burner directed toward the combustion chamber is decentered from the center of the cooling water tube array so as to be away from the first opening.

5. The water-tube boiler according to claim 1, wherein axis line of a burner directed toward the combustion chamber is tilted so as to be away from the first opening.

6. The water-tube boiler according to claim 1, wherein the cooling water tube array is made up of a plurality of water tube arrays.

7. The water-tube boiler according to claim 1, further comprising: a second water tube array made up of a plurality of second water tubes arranged into an annular shape outside the first water tube array; a second opening defined at part of the second water tube array; and a gas flow passage provided between the first water tube array and the second water tube array.

8. The water-tube boiler according to claim 1, wherein the space is free of heat absorbing members.

* * * * *